US005482097A

United States Patent [19]

Maine

[11] Patent Number: 5,482,097

[45] Date of Patent: Jan. 9, 1996

[54] WOOD SPLITTING MAUL

[76] Inventor: Nelson D. Maine, 138 Western Ave., Henniker, N.H. 03242

[21] Appl. No.: 389,132

[22] Filed: Feb. 14, 1995

Related U.S. Application Data

[63] Continuation-in-part of Ser. No. 216,257, Mar. 22, 1994, Pat. No. 5,394,917.

[51] Int. Cl.[6] ..... B27L 7/00; B26B 23/00

[52] U.S. Cl. ..... 144/193 C; 30/308.1; 144/193 R

[58] Field of Search ..... 81/20–27, 488; 30/308.1; 144/193 R, 193 C, 377

[56] References Cited

U.S. PATENT DOCUMENTS

| | | | |
|---|---|---|---|
| 755,891 | 3/1904 | Leathers | 30/308.1 |
| 3,735,434 | 5/1973 | Penberthy | 30/308.1 X |
| 4,433,709 | 2/1984 | Porter | 30/308.1 X |
| 4,882,955 | 11/1989 | Savnik | 81/20 |

*Primary Examiner*—W. Donald Bray
*Attorney, Agent, or Firm*—George W. Dishong

[57] ABSTRACT

An improved wood splitting maul wherein the striking edge is at an improved angle and the head unit has a substantially flat outward surface substantially perpendicular to a handle when the handle is assembled to the head unit. The improved angle makes the maul easier to use, more efficient, and provides less shock to a user's body. The improved angle is defined by a straight line essentially running along the length of the splitting edge (or hammer face) to a point at a pivot point defined between about the bottom end of the handle where the maul is grasped while in use and the approximate location of the elbow of the user of the maul and a line along the longitudinal axis of the handle. The exact degree or the absolute optimum value of the angle is a function of the handle length, the distance of the splitting edge (or hammer face) from the handle axis and the size of the user of the maul. The efficiency is improved to such a degree that a handle of only 28 inches in length provides improved performance in the manual splitting of wood.

19 Claims, 2 Drawing Sheets

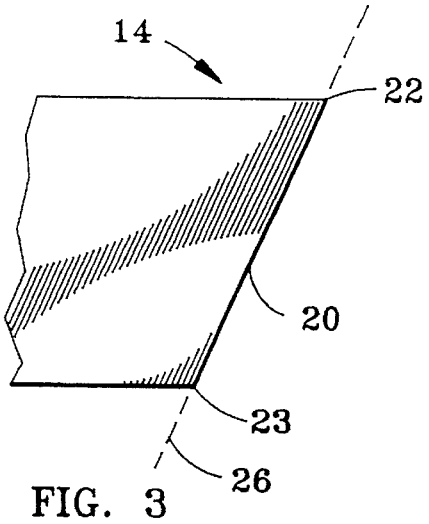
FIG. 3
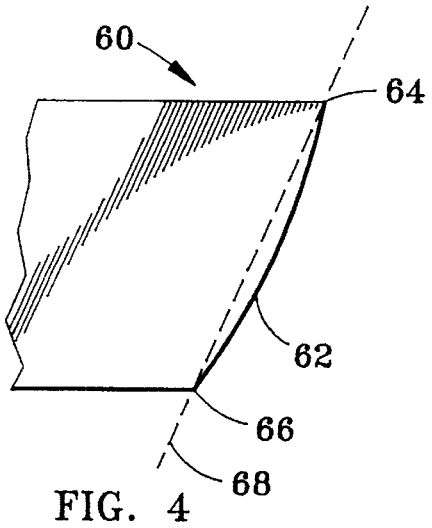
FIG. 4
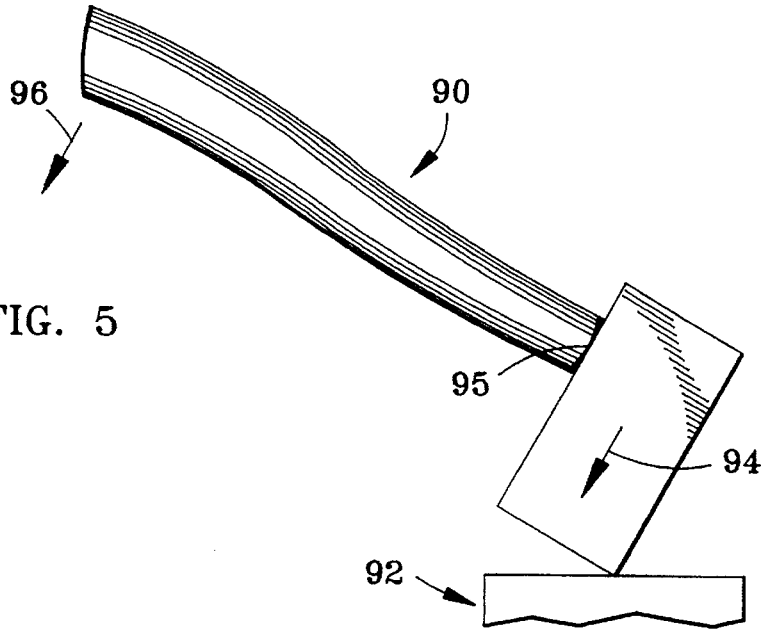
FIG. 5
FIG. 6
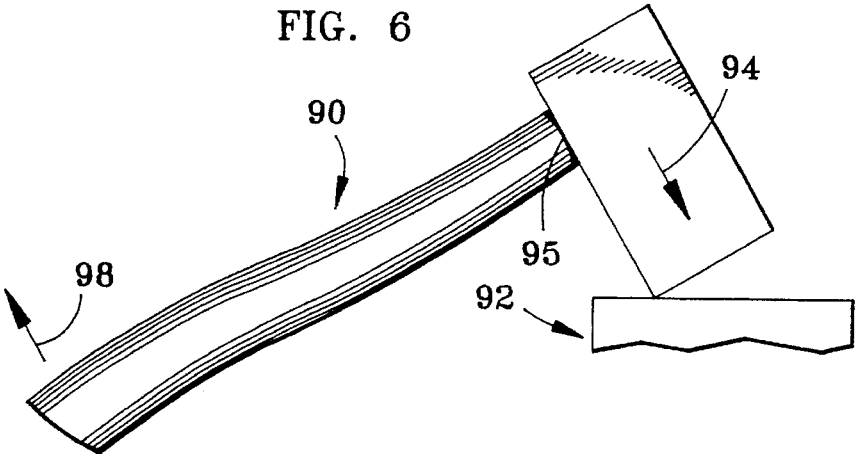

WOOD SPLITTING MAUL

This application is a continuation-in-part of application Ser. No. 08/216,252, filed Mar. 22, 1994 which application will issue as U.S. Pat. No. 5,394,917 on Mar. 7, 1995.

BACKGROUND OF THE INVENTION

1. Field of the Invention

This invention most generally relates to portable striking tools, more particularly to mauls, sledges, and single-bit and double-bit axes with an improved striking face angle. Even more particularly to a wood splitting maul having a head unit with an improved striking face angle and a handle. The improved angle is created by a straight line of the face extended to a pivot point in a bottom end of the handle substantially at a user gripping section and a line along the longitudinal axis of the handle. The improved wood splitting maul has additionally incorporated therein a head unit having a substantially flat outward surface substantially perpendicular to a handle when the handle is assembled to the head unit.

2. Description of the Prior Art

Not much has been described regarding the angle of the striking face of a tool. U.S. Pat. No. 4,433,709 by Porter describes a drywall hatchet with a striking end at an angle of about 95 degrees to enable the user to drive nails close to the intersection of two room surfaces and to reduce the risk of dimpling the drywall. U.S. Pat. No. 4,882,955 by Savnich teaches a hammer with a generally square striking head offset 45 degrees to improve vision and accuracy, but no angle is specified for the striking face. U.S. Pat. No. 5,261,164 by Bellegante teaches a swiveled axe and hatchet where the striking face angle is varied by a flexible joint in the handle for use by firemen.

It should be further noted that no attention has been given to providing a surface as a part of the tool which permits the user to stand the tool upright. In other words, be able to set the tool down in such a manner so that the handle is readily available to the user when another piece of wood is ready to be struck with the tool. It is recognized by those who use a wood splitting maul that considerable energy is expended by the user in bending over to pick up the tool each time it is layed down. Perhaps as much energy is expended in this action as is expended in the swinging of the maul to accomplish the wood splitting function.

The safe way to split wood is to adopt a swing bending the knees so that the hands end up at approximately the same height as the head of the maul or axe at the end of the stroke. If one stands with his knees straight without bending over and the implement misses the intended target, the axe, maul, or sledge may continue its arc and strike the leg or foot of the worker. Therefore, the bending of the knees and the lowering of the hands is an important safety step.

Generally, the prior art shows a head unit with an angle of the striking edge or face which is substantially parallel to the handle. Using a safe wood splitting technique with the prior art maul results in the striking edge surface meeting a log surface or a wedge surface at an angle. This uneven contact results in a loss of energy, a burring of the wedge and/or the striking face (if metal to metal contact), and a jarring sensation to both the handle and the human user. Over a period of time these slight imperfect contacts result in unnecessary fatigue to the user through loss of efficiency, burring of striking surfaces, breakage or weakening of handles, and possibly significant jarring to the user. Observe that a hardware store will stock as many spare handles as original mauls, axes, and sledges. They expect the handles to break in ordinary usage.

It would be desirable and advantageous to have the striking face parallel to the wood to be split if the sharp end of a maul is used. It would also be desirable and advantageous if the striking face of a sledge (or blunt end of a mall) would be parallel to the metal wedge to eliminate the disadvantages outlined above. It would be an additional advantage if the improvements cost no more than for a normal maul or sledge hammer. It would further be desireable to have a maul which could be set down by the user in such a manner as to make the handle accessible to the user without the user having to bend over to grab the handle thereby saving a substantial amount of energy that need be expended by the user in the process of splitting wood.

SUMMARY OF THE INVENTION

Basically the present invention in its most simple form or embodiment has the striking surface of the maul or sledge hammer at an angle defined by a straight line through an uppermost point and a lowermost point on a striking tool head unit striking face to a pivot spot substantially between a handle bottom end where the hands would grasp the tool in normal use and the approximate location of the elbow of the user and a line along the longitudinal axis of the handle. The exact location of the pivot and thus the angular measure of the angle formed by the two lines is necessarily a compromise location and angular value because of the differences in the size of the persons using the maul The inventor hereof wishes to further provide some reflections which lend additional insight into how and why the invention developed as it has.

Having split wood a good part of his life (80 years), he came to the conclusion that the wood-splitting mauls, as they are manufactured today are about the poorest tool imaginable. There appears to be no engineering considerations given to the design of the tool.

Up until the time that he got into the chain saw business, he never gave any thought as to why, after installing several hundred handles, he noticed that they were being broken by good woodsmen with no sign of why they broke. To try to solve this problem, he watched several people swing their splitting mauls.

It became quite clear what was causing the problem. What was involved was centrifugal force and a 360 degree angle. A maul head, from any he has seen, would work very well in a pile driver. Put a handle on it and you can no longer bring it down straight. No matter if you swing only one foot in distance, it is part of the 360 degree circle. The back corner of the splitting edge would cause a percentage of the power to be wasted. Worse, the power lost had to go somewhere. It ended up trying to break the handle and put a terrific strain on arms and back.

Using a cutting torch he cut out what he thought was a perfect splitting head. He angled the splitting edge so that a straight-edge placed in the center of the cutting edge would line up with the handle at about 44 inches. He left the steel wedge-striking end (the hammer face) with no angle. After cutting and splitting considerable amounts of wood and using the hammer face to hit wedges in the process of wood-splitting because of the soft metal of the maul head the hammer face "peened" over.

After grinding the splayed edge, i.e., the burrs off a home-made (soft metal) maul one day, the inventor noticed the surface of the hammer face was no longer flat but had substantially the same angle as the cutting edge. That is, the angle formed by a line defined by the hammer face and the center line of the handle was about the same angle as that of the cutting edge. The surface of the hammer end of his maul, if extended, pointed to a pivot point somewhere between approximately the handle bottom end where his hands normally held the maul and the location of his elbow of his left arm (which elbow location may be the "pivot location or pivot point". He made another maul designing the end with splitting edge along this same angle. With the new angle of the striking surface, the inventor noticed a much improved efficiency. Less energy was required to split the wood. Because less energy was required, the inventor was able to shorten the handle to approximately 28 inches, still use less force, and take a shorter swing than before. Yet his results were the same or better than before. The angle of the burring of the blunt end did not change with further and continued use. There was almost no handle breakage anymore. Although not verified through clinical studies, he felt much less tired and fewer aches and pains than before. He attributed this reduced level of discomfort to less jarring because of parallel strikes which resulted in no handle counter forces. Clearly, it appeared that there had to be considerable advantages in making the splitting maul with the angle substantially as described. People who have been involved in the wood splitting and cutting business have for many years been concerned about the breakage of handles by very experienced users. Why did handles break when there was no evidence of so-called "strike over" (that is causing the handle to hit upon the target rather than the maul or sledge head hitting on the target)? The answer lay in the fact that unwanted forces develop in the handle wasting energy and causing handle breakage. These undesireable or unwanted forces are cause at least in part by the lack of an appropriate angle to the cutting edge and the hammer face.

Clearly, the improved face angle may have a variety of applications more than just a splitting maul, such as sledges or single-bit or double-bit axes and may be made from a variety of materials.

An advantage of such an improvement is saving wear and tear on the tool itself. A look at a hardware store where such items are displayed will confirm the fact the stores stock as many replacement handles as original tools.

The inventor having spent many years working with splitting mauls further recognized that it would be wonderful if the maul was designed so that when it must be set down (which is frequently necessary), for such reasons that wood may be positioned or repositioned or split wood needed to be moved, it could be set down in such a way so as to not require bending over to pick up the tool for further use. Realizing that perhaps as much energy is used in bending over each time to pick up the tool as is used to split the wood, he designed the head unit with a substantially flat outward surface. When the head of the maul is set down upon a reasonably flat surface, the handle extends straight up making it simple and easy for the user to grasp.

It is a primary object of the present invention to provide a striking tool head unit suitable for attaching a handle where at least one of the striking faces conform to the improved angle described above and where there is further provided on the head unit a substantially flat outward surface substantially perpendicular to the axis of the aperture to which the handle would be attached.

It is a further primary object of the present invention to provide a striking tool comprising a head unit and handle where one or both of the edges (or face) conform the improved angle described above and where there is further provided on the head unit a substantially flat outward surface substantially perpendicular to the axis of the aperture to which the handle would be attached.

It is a another primary object of the present invention to provide an improved wood splitting maul where the striking faces conform the improved angle described above and where there is further provided on the improved wood splitting maul a substantially flat outward surface substantially perpendicular to the axis of the aperture to which the handle would be attached.

These and further objects of the present invention will become apparent to those skilled in the art after a study of the present disclosure of the invention and with reference to the accompanying drawings which are a part hereof, wherein like numerals refer to like parts throughout, and in which:

BRIEF DESCRIPTION OF THE DRAWINGS

FIG. 3 is a side partial view of the end of the straight face embodiment.

FIG. 4 is a side partial view of the end of the slight curved face embodiment.

FIG. 5 is a side plan view of the applied force and upward resultant force from a non-parallel strike.

FIG. 6 is a side plan view of the applied force and downward resultant force from a non-parallel strike.

DESCRIPTION OF THE PREFERRED EMBODIMENTS

The following is a description of the preferred embodiment of the invention. It is clear that there may be variations in the tools to which this invention may apply. The construction, exact shape, and material of the head units may vary to the use intended. Likewise, handles my vary in size, shape, or material composition. However, the main features of the invention is consistent: the angle of the striking surface of the splitting edge is defined by a straight line through a topmost point and a lowermost point of a striking edge to a pivot point at the handle bottom end where the tool is grasped by a user and a line through the longitudinal axis of the handle; and the head unit has a flat outward surface substantially flat and perpendicular to the center line of the handle mounting aperture and adjacent to the topmost point of the striking surface permitting the tool to be set down in such a manner as to cause the handle to be directed upright from the surface upon which the tool is placed. Access is thus provided to the handle of the tool without the need for the user to bend over to pick it up. The exact angle is a function of the handle length and head unit width.

Figure 1:
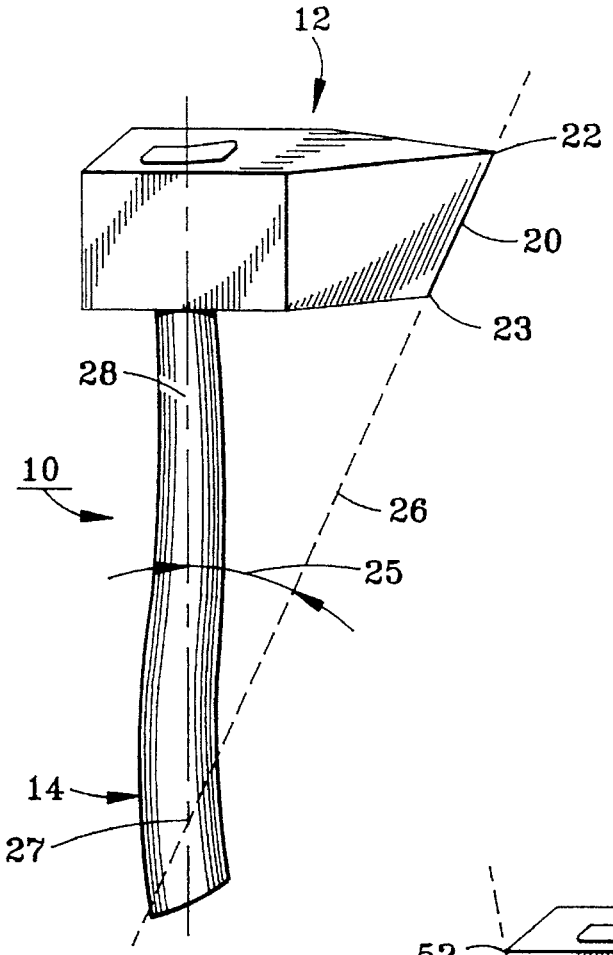
FIG. 1 is a perspective view of a maul with one edge at an improved angle.

Reference is now made to FIG. 1. Wood splitting maul 10 is shown having a head unit 12 with a handle 14 suitably attached. The head unit 12 has a splitting edge 20 which has a topmost point 22 and a lowermost point 23. Improved angle 25 is determined by a straight line 26 from the topmost point 22, through lowermost point 24 to a handle pivot point 27 and a line on the longitudinal axis 28 of handle 14. It is important to note that angle 25 has a magnitude which may vary as a function of the length of handle 14 and also the size of the user of the maul. It appears that the true pivot point may be at the approximate location of the elbow of the user. However, pivot point 27 must be characterized as lying somewhere between the user gripping location of the handle and the approximate location of the elbow of the user of the maul. Substantially flat outward surface 21 is shown relative to the centerline of handle 14.

Figure 2:
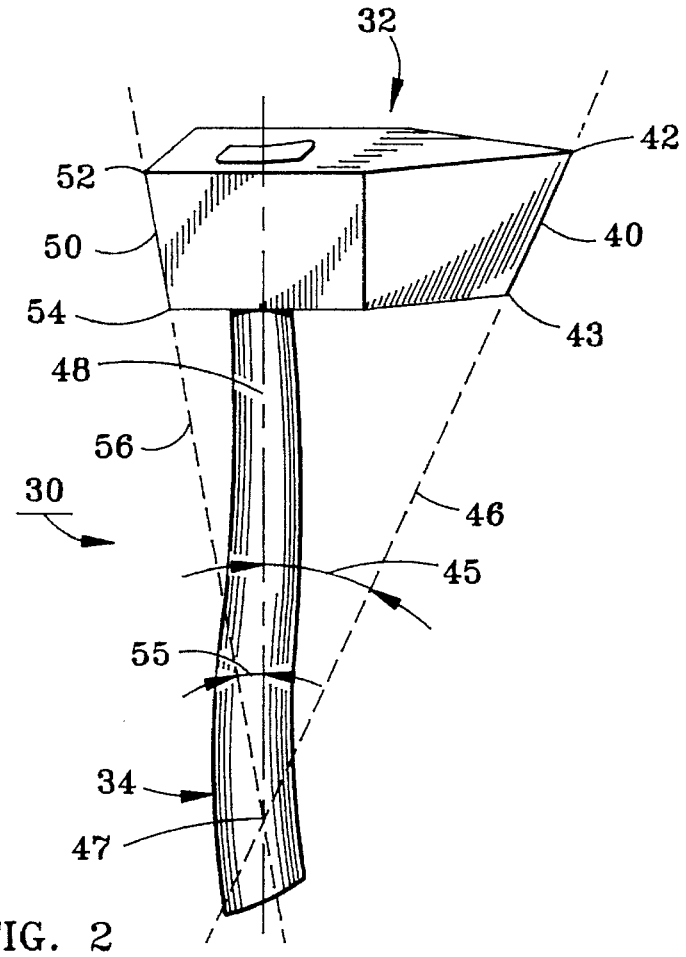
FIG. 2 is a perspective view of an embodiment with both the front and back striking faces at the improved angle.

FIG. 2 shows another embodiment of the invention. A wood splitting maul 30 is shown having a head unit 32 with a handle 34 suitably attached. The head unit 32 has a splitting edge 40 which has a topmost point 42 and a lowermost point 43 and a hammer end 50 which has a topmost point 52 and a lowermost point 54. The splitting edge 40 has an improved angle 45 which is determined by a straight line 46 from the topmost point 42, through lowermost point 44 to a handle pivot point 47 and a line along the longitudinal axis 48 of handle 34. The hammer face 50 has an improved angle 55 which is determined by a straight line 56 from the topmost point 52, through lowermost point 54 to the handle pivot point 47 and the longitudinal axis 48 of handle 34. Here again pivot point 47 is defineable as being between about the grip section of the handle and about the location of the elbow of the user of the maul. Substantially flat outward surface 31 is shown to be adjacent to the topmost point of the splitting edge and substantially perpendicular relative to the centerline of handle 34.

FIG. 3 shows a detail of splitting edge 20 of head unit 12. The straight line 26 is shown connecting topmost point 22 and lowermost point 24. This embodiment shows splitting edge 20 to be an essentially straight line. FIG. 4 shows a detail of another embodiment. A head unit 60 is shown with a splitting edge 62 which is slightly curved. This embodiment is different because the splitting edge 62 is slightly convex although still generally defined by a straight line 68. A topmost point 64 and a lowermost point 66 are shown with the straight line 68 which are similar to their counterpoints in the other embodiments.

FIGS. 5 and 6 show the result of an ordinary maul 90, which could b e a maul, single-bit or double-bit axe, or sledge, when the surfaces are not parallel. In FIG. 5, when maul 90 is swung toward target object 92, the applied force 94 is down. The maul 90 stops and the maul rotates around pivot point 95 and resultant force 96 is a downward thrust of the handle. The resultant thrust, although slight, jars the user and weakens the handle. In FIG. 6, when maul 90 is swung toward target object 92, the applied force 94 is down. The maul 90 stops and the maul rotates around pivot point 95 and resultant force 98 is an upward thrust of the handle.

The use of an improved wood splitting maul is no different than the use of the mauls defined in the prior art. The safe way to split wood was described above. The user bends his knees and back to finish the swing so that his hands are close to the level of the target object. The difference is in the result: less work expended by the person, more efficient splitting of the wood, and less wear and tear on the equipment and user.

It is thought that improved mauls 10 and 30 and many of the attendant advantages will be understood from the foregoing description and it will be apparent that various changes may be made in the type of striking tool, in the size, the construction, arrangement and materials used for the parts thereof without departing from the spirit and scope of the invention or sacrificing all of its material advantages, the form hereinbefore described being merely a preferred or exemplary embodiment thereof.

I claim:

1. In an improved striking tool head unit having a means for attaching a handle of predetermined length with a head end and a bottom end, said head unit having incorporated thereon at least one striking face said improvement comprising:

at least one striking face having a topmost point and a lowermost point;

a striking face angle substantially defined by a drawn straight line connecting said topmost point and said lowermost point of said striking face to a pivot point and an axis of said handle when said handle is attached to said striking tool head unit, said handle pivot point located between substantially a user gripping section proximate said bottom end and a location defined by about the elbow of a user of said improved striking tool head unit with said handle attached thereto; and a substantially flat outward surface substantially perpendicular to said handle when said handle is attached to said head unit said flat outward surface being adjacent to said topmost point of said striking face.

2. The improved striking tool head unit according to claim 1 wherein said at least one of said striking faces of said head unit is a splitting edge.

3. The improved striking tool head unit according to claim 1 wherein said at least one of said striking faces of said head unit is a hammer face.

4. The improved striking tool head unit according to claim 1 wherein said head unit has two striking faces one of said two striking faces is a splitting edge and a second striking face is a hammer face and wherein said splitting edge has a topmost point and a lowermost point and said striking face angle.

5. The improved striking tool head unit according to claim 1 wherein said head unit has two striking faces one of said two striking faces is a splitting edge and a second striking face is a hammer face and wherein each of said two striking faces has a topmost point and a lowermost point and each has said striking face angle.

6. The improved striking tool head unit according to claim 1 wherein said head unit has two striking faces one of two said striking faces is a first splitting edge and a second face is a second splitting edge and wherein each of said two striking faces has a topmost point and a lowermost point and each has said striking face angle.

7. An improved striking tool as in claim 1, when said handle is attached to said striking head, said handle is substantially 28 inches in total length.

8. In an improved striking tool with a head unit and a handle unit of predetermined length attached to said head unit at a head end of said handle unit, said head unit having incorporated thereon at least one striking face, said handle unit with said head end and a bottom end, said improvement comprising:

at least one striking face having a topmost point and a lowermost point;

a pivot point located between substantially a user gripping section proximate said bottom end and a location defined by about the elbow of a user of said improved striking tool;

a striking face angle substantially defined by a drawn straight line connecting said topmost point and said lowermost point of said striking face to said pivot point and an axis of said handle; and a substantially flat outward surface incorporated on said head unit substantially perpendicular to said handle.

9. The improved striking tool head unit according to claim 8 wherein said at least one of said striking faces of said head unit is a splitting edge.

10. The improved striking tool head unit according to claim 8 wherein said at least one of said striking faces of said head unit is a hammer face.

11. The improved striking tool head unit according to claim 8 wherein said head unit has two striking faces one of said two striking faces is a splitting edge and a second striking face is a hammer face and wherein said splitting edge has a topmost point and a lowermost point and said striking face angle.

12. The improved striking tool head unit according to claim 8 wherein said head unit has two striking faces one of said two striking faces is a splitting edge and a second striking face is a hammer face and wherein each of said two striking faces has a topmost point and a lowermost point and each has said striking face angle.

13. The improved striking tool head unit according to claim 8 wherein said head unit has two striking faces one of two said striking faces is a first splitting edge and a second face is a second splitting edge and wherein each of said two striking faces has a topmost point and a lowermost point and each has said striking face angle.

14. An improved striking tool as in claim 8, in which said handle is substantially 28 inches in total length.

15. In an improved wood splitting maul with a head unit and a handle unit of predetermined length attached to said head unit at a head end of said handle unit, said head unit having incorporated thereon at least one splitting edge, said handle unit with a head end and a bottom end, said improvement comprising:

at least one striking face having a topmost point and a lowermost point;

a pivot point located between substantially a user gripping section proximate said bottom end and a location defined by about the elbow of a user of said improved wood splitting maul;

a striking face angle substantially defined by a drawn straight line connecting said topmost point and said lowermost point of said striking face to said handle pivot point and an axis of said handle; and a substantially flat outward surface incorporated on said head unit substantially perpendicular to said handle.

16. The improved wood splitting maul according to claim 15 wherein said head unit has two striking faces one of said two striking faces is a splitting edge and a second striking face is a hammer face and wherein said splitting edge has a topmost point and a lowermost point and said striking face angle.

17. The improved wood splitting maul according to claim 15 wherein said head unit has two striking faces one of said two striking faces is a splitting edge and a second striking face is a hammer face and wherein each of said two striking faces has a topmost point and a lowermost point and each has said striking face angle.

18. The improved wood splitting maul according to claim 15 wherein said head unit has two striking faces one of two said striking faces is a first splitting edge and a second face is a second splitting edge and wherein each of said two striking faces has a topmost point and a lowermost point and each has said striking face angle.

19. An improved wood splitting maul according to claim 15, in which said handle is substantially 28 inches in total length.

* * * * *